United States Patent [19]

Van Sickle

[11] 4,208,946

[45] Jun. 24, 1980

[54] FIREARM ALIGNMENT AND SUPPORT APPARATUS

[76] Inventor: Norman E. Van Sickle, 6 N. 1st, Council Bluffs, Iowa 51501

[21] Appl. No.: 871,293

[22] Filed: Jan. 23, 1978

[51] Int. Cl.[2] ..... F41C 3/02

[52] U.S. Cl. ..... 89/37 BA; 89/40 E; 248/179; 248/180; 248/515

[58] Field of Search ..... 42/1 Z, 94; 89/37 R, 89/37 A, 37 BA, 40 E; 248/178, 179, 180

[56] References Cited

U.S. PATENT DOCUMENTS

| | | | |
|---|---|---|---|
| 577,829 | 2/1897 | Brown | 248/180 |
| 1,196,197 | 8/1916 | Witherow | 89/40 E |
| 3,051,425 | 8/1962 | Homrighausen | 248/180 |
| 3,350,783 | 11/1967 | Whitehead | 42/1 Z |

FOREIGN PATENT DOCUMENTS

| | | | |
|---|---|---|---|
| 686210 | 7/1930 | France | 89/40 E |

*Primary Examiner*—Stephen C. Bentley
*Attorney, Agent, or Firm*—Henderson & Sturm

[57] ABSTRACT

A firearm alignment and support apparatus is disclosed, including a vertical support member, an alignment and holding unit and a firearm cradle unit. The apparatus is designed for use with a conventional surveyor's tripod, and is primarily for use in the surveying method known as vertical projection surveying.

11 Claims, 8 Drawing Figures

FIREARM ALIGNMENT AND SUPPORT APPARATUS

BACKGROUND OF THE INVENTION

The instant invention relates generally to surveying, and more particularly to an apparatus for use in vertical projection surveying.

Vertical projection surveying is a fairly recent surveying technique whereby one surveyor fires a magnesium tracer bullet vertically into the air, which bullet makes a visible firey trail that may be sighted upon by a second surveyor using a conventional surveyor's transit or the more sophisticated theodolite. The technique is particularly useful where the surveyor is working in an area that is predominately hilly, or otherwise covered by visual obstacles to the horizontal line of sight.

In order to ensure accuracy when using the above technique, it is extremely important that the trace left by the magnesium bullet be as nearly vertical as possible. This, of course, is most easily accomplished by maintaining the gun barrel through which the bullet is shot at a vertical position. Maintaining a projectile firing device, and in particular a pistol, in such a vertical position is not without its difficulties. Not only must the weapon be initially set at its most vertical position, but it must be maintained in that status through the cocking and firing of the gun.

The prime advantage of the vertical projection surveying technique over standard surveying techniques is the substantial savings of time realized when working in unfavorable terrain. If the weapon alignment and support apparatus requires an excessive amount of time to set up, the savings in time by using the vertical projection technique will be frustrated. Therefore, it is very important that the alignment and support apparatus be easily and rapidly preparable for firing.

SUMMARY OF THE INVENTION

It is therefore, a primary object of this invention to provide a firearm alignment and support apparatus for use in vertical projection surveying techniques.

It is another object of this invention to provide a firearm alignment and support apparatus that is easily and rapidly made ready for firing.

It is another object of this invention to provide a firearm alignment and support apparatus that will accurately position and maintain a firearm such that the barrel is vertically aligned.

It is yet another object of the present invention to provide a firearm alignment and support apparatus that is usable with conventional surveyor's tripod equipment.

It is another object of the instant invention to provide a firearm alignment and support apparatus that includes an internal plumb bob or spirit bubble device for rapid and accurate alignment of the apparatus with the vertical.

It is yet still another object of the instant invention to provide a firearm alignment and support apparatus that is inexpensive of manufacture, durable of construction and highly efficient in use.

These and other objects are realized by a firearm alignment and support apparatus including a vertical support member, an alignment and holding unit and a firearm cradle unit. The apparatus is designed for use with a conventional surveyor's tripod, and is primarily for use in the surveying method known as vertical projection surveying.

BRIEF DESCRIPTION OF THE DRAWINGS

These and other objects will become more readily apparent upon reference to the following detailed disclosure of the invention, especially when viewed in conjunction with the appended drawings, wherein.

DESCRIPTION OF THE PREFERRED EMBODIMENTS

Figure 1:
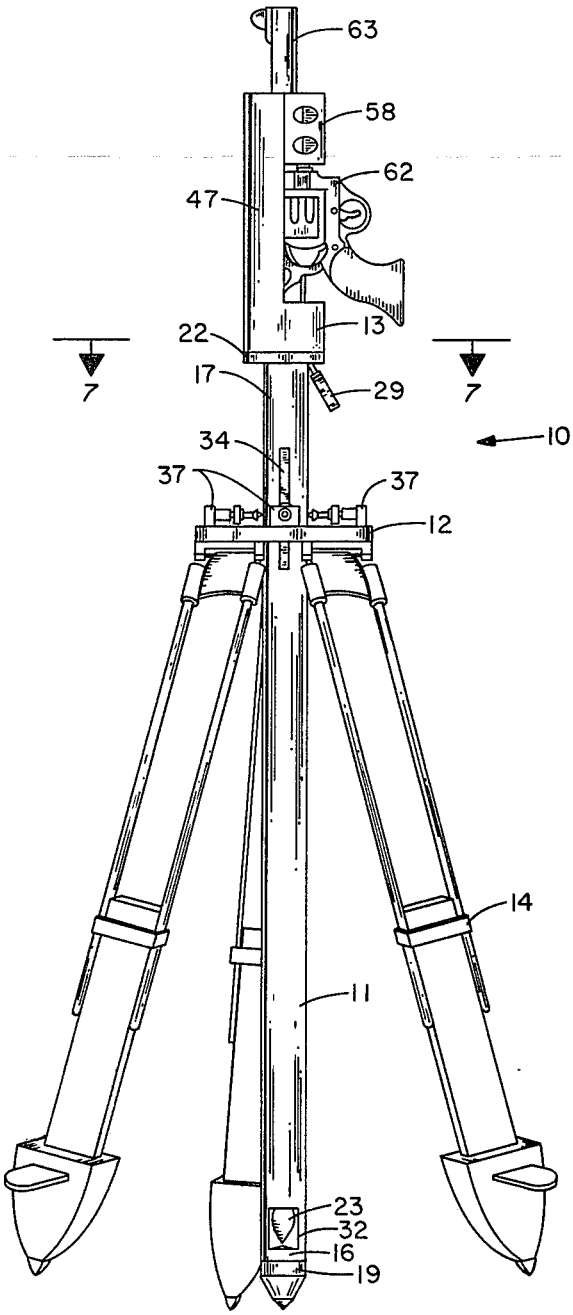
FIG. 1 is a front elevational view of the apparatus affixed in conjunction with a standard tripod.

Referring now to FIG. 1, the apparatus may be seen generally as depicted by the numeral 10. More specifically, the apparatus includes a vertical support member 11, an alignment and holding unit 12 and a firearm cradle unit 13. A conventional surveyor's tripod 14 is also depicted in conjunction with the apparatus 10.

Figure 2:
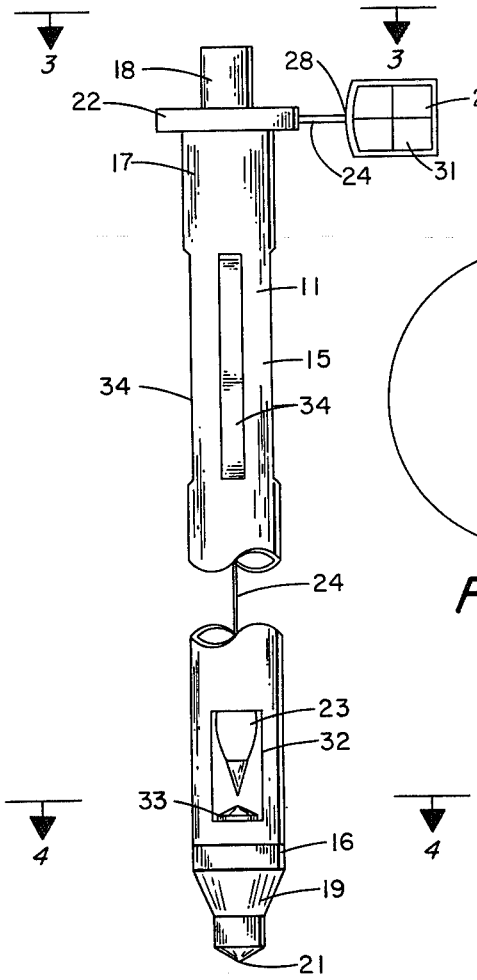
FIG. 2 is a front elevational view of the vertical support member, shown in partial section.

Referring now to FIG. 2, the vertical support member 11 includes a ground engaging first end 16 and a second end 17 having a pistol cradle engagement member 18 protruding vertically therefrom. The vertical support member 11 in this embodiment is constructed of a length of hollow pipe 15. The ground engaging first end 16 includes a ground engaging unit 19 of a shape suitable for soil penetration. In this embodiment, the circumference of the gound engaging unit widens rapidly from the point of penetration 21. The design is such because the ground engaging unit 19 is meant as an aid to the overall support of the apparatus 10 and is not intended for deep terrain penetration. The second end 17 of the vertical support member 11 is attached to a circular cradle plate 22, which plate 22 in this embodiment is of a larger radius than the vertical support member pipe 15. Projecting upwardly from the cradle plate 22, and attached thereto, is a cylindrically shaped firearm cradle engagement member 18.

Figure 3:
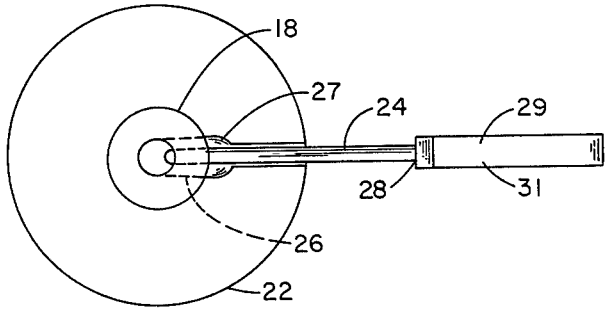
FIG. 3 is a top plan view of the vertical support member as shown in FIG. 2.
Figure 4:
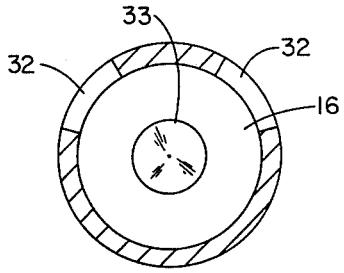
FIG. 4 is a plan sectional view of the vertical support member taken along the line 4—4 as shown in FIG. 2.
Figure 5:
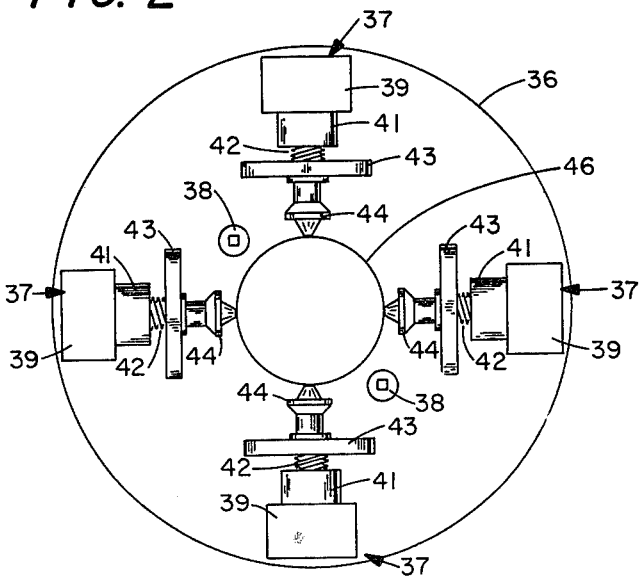
FIG. 5 is a top plan view of the alignment and holding unit.

In order to facilitate vertical alignment of the vertical support member 11, a plumb bob 23 is included within the interior of the hollow vertical support member pipe 15. The plumb bob 23 is suspended by a cord 24 which cord 24 is disposed upwardly through the length of the support pipe 15, and through the second end 17. With reference to FIG. 3, a hole 26 is disposed through said firearm cradle engagement unit 18 and a trough 27 is disposed in the cradle plate 22, such that the cord 24 may be disposed therethrough. The end 28 of the cord 24 so disposed is connected to a suitable object 29, such that the connected end 28 of the cord 24 will not slip through the trough 27 and hole 26. In this embodiment, a small plastic box 31 was used. As viewed in FIGS. 2 and 4, two rectangularly shaped windows 32 have been disposed through the vertical support member pipe 15 so that the plumb bob 23 may be observed. To further facilitate vertical alignment, a counter point unit 33 is provided proximate the first end 16, which counter point 33 provides the reference point for aligning the plumb bob 23.

Finally, the vertical support member 11 includes four level surfaces 34 proximate the second end 17. The surfaces 34 are located every 90° around the support member. (Only three of the surfaces 34 are visible in FIG. 2). The purpose of these level surfaces 34 will be made apparent below.

The alignment and holding unit 12 includes generally a circular plate 36 and four adjustable holding tools 37. The plate 36 includes two bolts 38 for attachment to a surveyor's tripod 14. The holding tools 37 are connected by bolts or the like to the plate 36 at 90° intervals. Each tool 37 is identical to the other three, and a detailed description of one will thereby serve to disclose the remaining three, and like numerals will refer to like parts throughout. Each tool 37 includes a support block 39, a tapped collar 41 connected to the support block 39, a threaded shaft 42 disposed partially within the tapped collar 41, an adjustment wheel 43 attached to the threaded shaft 42, and a nipple 44 attached to the adjustment wheel 43. The plate 36 also includes a hole 46 centrally disposed therethrough, the hole 46 being of a diameter sufficient to receive the vertical support member pipe 15 therethrough. When the pipe 15 is so disposed, (see FIG. 1) each tool nipple 44 will face one of the level surfaces 34 on the vertical support member pipe 15. By turning the adjustment wheels 43, the nipples 44 may be brought into contact with the pipe 15 as the threaded shaft 42 moves in or out of the tapped collar 41. The level surface 34 provides a flat point of tangency for contact between the nipple 44 and the vertical support member pipe 15.

Figure 6:
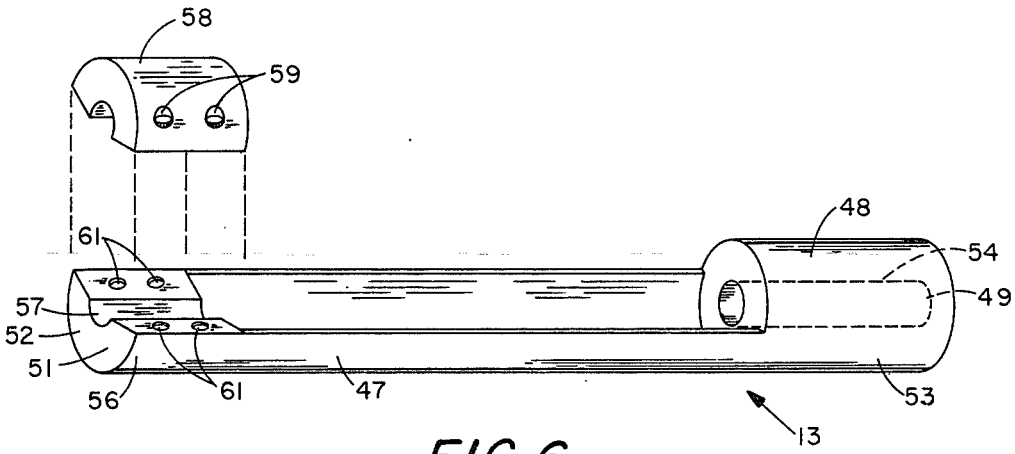
FIG. 6 is an exploded perspective view of the firearm cradle unit.

Finally, the firearm cradle unit 13 is seen in FIG. 6. The cradle 13 includes a trough 47 with a first end 48 having a female receptacle 49 for engagement with the firearm cradle engagement member 18 and a second end 51 having a firearm support unit 52. More specifically, the first end 48 includes a solid cylinder 53 having a hole 54 disposed centrally therethrough of a diameter such that the firearm cradle engagement member 18 may be fit snugly thereinto. The second end 51 also includes a solid cylinder 56 having a hole 57 disposed axially therethrough of a size to snugly retain a firearm barrel therein. The second end 51 is longitudinally severed such that a portion 58 thereof may be removed. This portion 58 includes four recessed bolts 59 for engagement with a like number of tapped holes 61 disposed through that part of the cylinder 56 remaining connected to the firearm cradle unit 13.

The operation of the apparatus may now be disclosed. Initially, a firearm 62 (here a .45 cal. pistol) is disposed within the firearm cradle unit 13 such that the barrel 63 is disposed within the hole 57 included in the second end 51. The removable portion 58 thereof is secured by the four bolts 59 such that the firearm 62 is tightly held and may not be rotated or longitudinally moved. The alignment and holding unit 12 is connected to the top of a surveyor's tripod 14 by the aforementioned bolts 38, and the vertical support member 11 is disposed therethrough. The ground engaging unit 19 of the vertical support member 11 is then placed in proximate contact with the ground. The vertical support member 11 is rotated until the level surfaces 34 come into alignment with the adjustment tools 37. The pipe 15 is adjusted until the plumb bob 23 indicates that vertical alignment has been achieved. The adjustment tools 37 are then adjusted to substantially affix and support the vertical support member 11 in its vertical status. The firearm cradle unit 13 is then placed atop the vertical support member 11, and the firearm 62 is ready for firing.

It may be seen that vertical alignment is rapidly and easily achieved by the use of the above apparatus 11. Furthermore, the apparatus 10 operates to maintain the firearm barrel 63 in a vertical attitude at all critical times during the surveying technique.

Another important advantage realized by the instant invention is that the recoil shock resulting from the firing of the firearm 62 is transferred to the ground entirely by the vertical support member 11. The adjustment tools 37 do not hold the vertical support member 11 so tightly as to preclude all vertical movement, and therefore the recoil shock is rendered substantially harmless to the prior alignment setting. This is quite different from the result achieved by a mere tripod arrangement. Generally, with a tripod one leg will sink further than the other two as the recoil is absorbed, and the vertical alignment is no longer guaranteed. Furthermore, the conical end of the ground engaging unit 19 also contributes to vertical stability. When a downward force is exerted upon the vertical support member 11 by the recoil of the firearm 62, the pointed tip will tend to work its way down into the ground in a substantially vertical fashion, pushing rocks and other obstacles aside.

Figure 7:
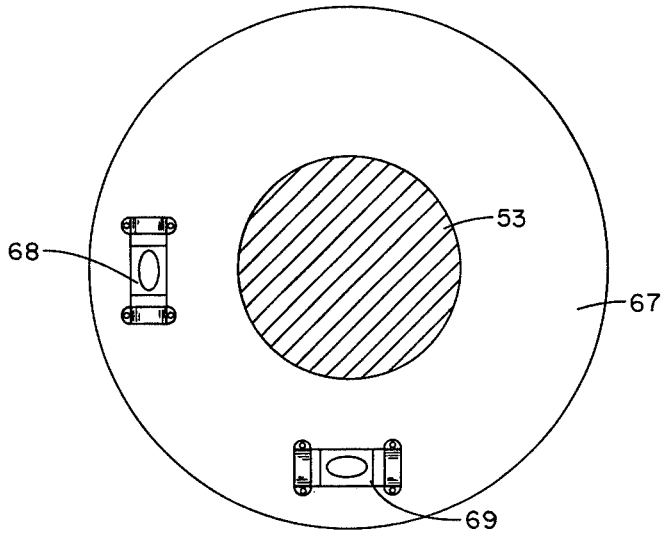
FIG. 7 is a sectional top plan view of a second embodiment of the vertical alignment unit taken along the lines 7—7 in FIG. 1.
Figure 8:
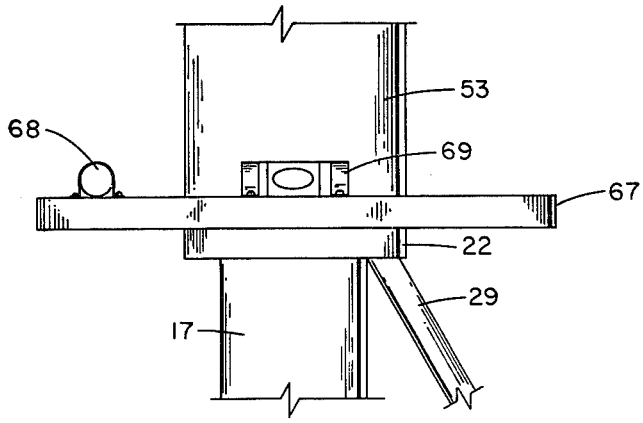
FIG. 8 is a side elevational view thereof.

A modified embodiment of the apparatus is depicted in FIGS. 7 and 8. In place of the vertical alignment unit described hereinabove, a bubble level unit 66 may be utilized. The bubble level unit 66 includes a level plate 67 secured between the cradle plate 22 and the cylinder 53. Mounted on the level plate and disposed at 90° spacing are a pair of conventional bubble levels 68 and 69. Use of the bubble levels would substantially reduce the time and effort to accomplish vertical alignment of the apparatus; however, the degree of accuracy may be affected by such use.

It should be obvious that the above description is but a preferred embodiment and that many variations would occur to those skilled in the art. Such variations are not to be considered without the scope of the claims.

I claim:

1. A firearm alignment and support apparatus for use with a tripod and a firearm having a trajectory barrel, comprising:

a vertical support member having a first end engageable with the ground and a second end;

alignment and holding means attachable to the tripod for vertically aligning and holding said vertical support member in a substantially vertical position; and a firearm cradle means engageable with the second end of said vertical support member for supporting the barrel of a firearm in a substantially vertical position; wherein said alignment and holding means includes a plate securable to the tripod having a hole disposed therethrough; and a plurality of adjustable alignment and holding tools attached to said plate, such that said vertical support member is disposed through the hole in said plate and said adjustable alignment and holding tools are adjustable to contact said vertical support member and position it in an alignment setting, said adjustable alignment and holding tools preventing said vertical support member from horizontal displacement while not preventing all vertical displacement of said vertical support member when said vertical support member is disposed through the hole in said plate, said adjustable alignment and holding tools thus permitting said vertical support member to move downward vertically in response to a recoil force resulting from the firing of said firearm, said vertical support member thus transferring said recoil force to the ground rather than to said tripod with the result that said alignment setting is not substantially disturbed by the firing of said firearm.

2. A firearm alignment and support apparatus as described in claim 1 wherein said firearm cradle means includes:

a firearm cradle unit having a first end and a second end, wherein:

said first end is non-permanently engageable with the second end of said vertical support member; and said second end is non-permanently engageable with the firearm.

3. A firearm alignment and support apparatus as described in claim 2 wherein said adjustable alignment and holding tools are disposed at 90° intervals about the hole disposed through said plate and said vertical support member includes a plurality of level surfaces disposed at 90° intervals circumferentially around the exterior of said vertical support member for providing a point of tangency between said vertical support member and said adjustable alignment and holding tools.

4. A firearm alignment and support apparatus as described in claim 3 wherein each of said adjustable alignment and holding tools includes:

a support block attached to said plate;

a tapped collar attached to said support block;

a threaded shaft at least partially threadably disposed in said tapped collar;

an adjustment wheel attached to said threaded shaft to facilitate the turning of said threaded shaft; and a nipple operably attached to said threaded shaft for providing a point of contact between said adjustable holding tool and said vertical support member.

5. A firearm alignment and support apparatus as described in claim 4 wherein:

said first end of said firearm cradle unit includes a cylinder having a cylindrically shaped hole disposed therethrough; and said second end of said vertical support member includes a cylindrically shaped appendage, such that said cylindrically shaped appendage is snugly insertable into said cylindrically shaped hole.

6. A firearm alignment and support apparatus as described in claim 5 wherein said second end of said firearm cradle unit includes:

a first part permanently attached to said second end and including a cylindrically shaped longitudinally disposed trough therein;

a second part non-permanently attachable to said first part and including a cylindrically shaped longitudinally disposed trough therein, such that when said second part is attached to said first part said troughs are aligned to form a cylindrical hole longitudinally disposed through said second end of said firearm cradle unit, and the barrel of a firearm is snugly insertable within said cylindrical hole in said second end.

7. A firearm alignment and support apparatus as described in claim 6 further including plumb bob means for ascertaining vertical alignment.

8. A firearm alignment and support apparatus as described in claim 7 wherein the first end of said vertical support member includes a ground engaging unit substantially conical in shape.

9. A firearm alignment and support apparatus as described in claim 8 wherein:

said vertical support member includes a pipe having a substantially hollow interior and one or more holes disposed laterally through said pipe proximate the first end of said vertical support member; and said plumb bob means includes:

a cord disposable substantially within the interior of said pipe having a first end restrainable proximate the second end of said vertical support member and a second end;

a plumb bob attached to the second end of said cord, said plumb bob being disposed within the interior of said pipe; and a counter point attached to the interior of said pipe proximate the first end thereof and positioned such than when said plumb bob is aligned with said counter point, said vertical support member will be vertically aligned, said plumb bob and said counter point being observable through said hole or holes disposed through said pipe proximate the first end of said vertical support member.

10. A firearm alignment and support apparatus as described in claim 8 wherein said plumb bob means includes a plurality of horizontally disposed spirit levels operably affixed to said apparatus.

11. The firearm alignment and support apparatus as described in claim 9 wherein said vertical support member includes a window to observe the alignment of said plum bob with said counterpoint.

* * * * *